US008340332B2

(12) United States Patent
Nikles et al.

(10) Patent No.: US 8,340,332 B2
(45) Date of Patent: Dec. 25, 2012

(54) HEARING AID CONFIGURATION WITH A LANYARD WITH INTEGRATED ANTENNA AND ASSOCIATED METHOD FOR WIRELESS TRANSMISSION OF DATA

(75) Inventors: Peter Nikles, Erlangen (DE); Ulrich Schätzle, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 297 days.

(21) Appl. No.: 12/754,187

(22) Filed: Apr. 5, 2010

(65) Prior Publication Data

US 2010/0254553 A1 Oct. 7, 2010

Related U.S. Application Data

(60) Provisional application No. 61/167,203, filed on Apr. 7, 2009.

(30) Foreign Application Priority Data

Apr. 7, 2009 (DE) ..... 10 2009 016 661

(51) Int. Cl.
*H04R 25/04* (2006.01)
*H04R 25/00* (2006.01)

(52) U.S. Cl. ..... 381/314; 381/315

(58) Field of Classification Search ..... 381/314, 381/315, 323, 326, 327, 328, 331, 23.1
See application file for complete search history.

(56) References Cited

U.S. PATENT DOCUMENTS 3,985,977 A * 10/1976 Beaty et al. ..... 455/41.1
4,334,315 A * 6/1982 Ono et al. ..... 455/11.1
5,303,305 A * 4/1994 Raimo et al. ..... 381/323
5,425,104 A * 6/1995 Shennib ..... 381/326
5,615,229 A * 3/1997 Sharma et al. ..... 375/259
5,721,783 A * 2/1998 Anderson ..... 381/328
5,737,430 A * 4/1998 Widrow ..... 381/313
5,793,875 A * 8/1998 Lehr et al. ..... 381/313
6,035,050 A * 3/2000 Weinfurtner et al. ..... 381/313
6,118,882 A * 9/2000 Haynes ..... 381/374
6,208,740 B1 * 3/2001 Grever ..... 381/79
6,307,945 B1 * 10/2001 Hall ..... 381/315
6,594,370 B1 7/2003 Anderson
6,694,034 B2 * 2/2004 Julstrom et al. ..... 381/315
6,823,171 B1 * 11/2004 Kaario ..... 455/41.1
7,117,010 B2 * 10/2006 Shively et al. ..... 455/556.1
7,236,751 B2 * 6/2007 Ono ..... 455/90.3

(Continued)

FOREIGN PATENT DOCUMENTS

EP 1480492 A2 11/2004

(Continued)

*Primary Examiner* — Edgardo San Martin
(74) *Attorney, Agent, or Firm* — Laurence A. Greenberg; Werner H. Stemer; Ralph E. Locher

(57) ABSTRACT

A hearing aid configuration and an associated method provide wireless transmission of data between a hearing aid and an external unit. The external unit, for example a programming device, is worn with a lanyard around the neck of a hearing aid user. The configuration additionally contains at least one second antenna disposed in the lanyard and at least one third antenna arranged in the lanyard which is connected by an electric series circuit to the second antenna. The advantage of this is that the lanyard can be made long enough to be comfortable to wear and a sufficiently high receive signal of the wireless data transmission is still guaranteed in the external unit.

14 Claims, 4 Drawing Sheets

U.S. PATENT DOCUMENTS

| | | | | |
|---|---|---|---|---|
| 7,277,553 | B2 | 10/2007 | Reithinger | |
| 7,366,316 | B2 * | 4/2008 | Reithinger | 381/331 |
| 7,650,007 | B2 * | 1/2010 | Iuliis et al. | 381/385 |
| 7,738,666 | B2 * | 6/2010 | Marquis | 381/315 |
| 7,787,647 | B2 * | 8/2010 | Hagen et al. | 381/314 |
| 7,929,723 | B2 * | 4/2011 | Hagen et al. | 381/314 |
| 8,000,668 | B2 * | 8/2011 | Boguslavskij et al. | 455/217 |
| 8,094,859 | B2 * | 1/2012 | Suematsu et al. | 381/384 |
| 2006/0039577 | A1 | 2/2006 | Sanguino et al. | |
| 2006/0177086 | A1 * | 8/2006 | Rye et al. | 381/370 |
| 2007/0269065 | A1 * | 11/2007 | Kilsgaard | 381/315 |
| 2007/0291970 | A1 * | 12/2007 | Nikles et al. | 381/315 |
| 2008/0137888 | A1 * | 6/2008 | Newton et al. | 381/314 |
| 2009/0046879 | A1 * | 2/2009 | Knudsen et al. | 381/315 |
| 2010/0086154 | A1 * | 4/2010 | Frerking et al. | 381/315 |
| 2010/0329491 | A1 * | 12/2010 | Johansen | 381/315 |

FOREIGN PATENT DOCUMENTS

| | | | |
|---|---|---|---|
| EP | 1981176 | A1 | 10/2008 |
| WO | 2006023857 | A1 | 3/2006 |

* cited by examiner

HEARING AID CONFIGURATION WITH A LANYARD WITH INTEGRATED ANTENNA AND ASSOCIATED METHOD FOR WIRELESS TRANSMISSION OF DATA

CROSS-REFERENCE TO RELATED APPLICATION

This application claims the priority, under 35 U.S.C. §119 (e), of provisional application No. 61/167,203, filed Apr. 7, 2009; this application also claims the priority, under 35 U.S.C. §119, of German application DE 10 2009 016 661.0, filed Apr. 7, 2009; the prior applications are herewith incorporated by reference in their entirety.

BACKGROUND OF THE INVENTION

Field of the Invention

The invention relates to a hearing aid configuration with a lanyard and a method for wireless transmission of data between the hearing aid and an external unit.

For wireless programming of hearing aids with inductive antennas, for example with wound coils on ferrite cores, the receive level is low at a programming device since the transmit power of the hearing aid is restricted and the hearing aid antennas are configured to be small. The reason for this is the limited factory capacity and the lack of space available in hearing aids.

As a consequence of the low receive level the signal-to-noise ratio is low, which imposes heavy restrictions on the maximum data rate between the hearing aid and the programming device. To improve this situation a precise alignment of the antennas to each other is required. In such cases the signal-to noise ratio is adversely affected by the hearing aid wearer turning his head.

By contrast the transmit level in the programming device is high since there is enough space available for a battery with a large storage capacity. As a result of the high transmit level the signal-to-noise ratio at the location of the hearing aid is high, making a high maximum data rate between the programming device and the hearing aid possible. A precise alignment of the antennas to each other is not absolutely necessary.

Wireless programming of hearing aids is consequently very unsymmetrical. Data transmission is fast and secure when the programming device is sending data to the hearing aid but is slow and insecure when the programming device is receiving data from a hearing aid. It would thus be advantageous to find a possibility of enhancing the receive signal in the programming device.

A known solution lies in connecting the programming device to a neck strap, also referred to as a lanyard. For the highest possible receive signals the length of the lanyard must be as short as possible in order to keep the distance between the hearing aid and the programming device small. The disadvantage of this is that hearing aid users often do not want to wear short lanyards since these are uncomfortable to wear. The negative effect of turning one's head during a programming process is still present even with short lanyards.

Another solution is described in published European patent application EP 1 981 176 A1. A multi-strand of loop antenna is integrated into the lanyard. In addition a loop antenna is balanced with a capacitor in series resonance in order to increase the signal strength. The disadvantage of this is that the loop inductance of the loose lanyard varies greatly during use making resonance balancing difficult. In addition for safety reasons, to avoid the risk of strangulation, what are referred to as release or separation elements are integrated into the lanyard which release the lanyard when it is subjected to a predetermined force. Since the loop antenna must also be routed through the release element, contact problems often occur which restrict functional capabilities.

SUMMARY OF THE INVENTION

It is accordingly an object of the invention to provide a hearing aid configuration with a lanyard with an integrated antenna and an associated method for wireless transmission of data which overcome the above-mentioned disadvantages of the prior art methods and devices of this general type.

The invention recites a hearing aid configuration for wireless transmission of data between a hearing aid and an external unit which is worn on the lanyard around the neck of the hearing aid user. The configuration further contains at least one second antenna disposed in the lanyard and at least one third antenna arranged in the lanyard which is connected to the second antenna by of an electric series circuit. The advantage of this is that the lanyard can be embodied long enough to be comfortable to wear and that despite this a sufficiently high receive signal of wireless data transmission still arrives at the external unit.

In a development of the invention the second and third antenna can each be an inductive antenna. This ensures a secure near field data transmission with low power requirement.

In a further embodiment the data from the hearing aid can be coupled in in the second antenna and the data coupled in in the second antenna can be coupled in from the third antenna into the external unit. This offers the advantage of an additional indirect transmission path between the hearing aid and the external unit.

Furthermore the configuration can contain at least one first antenna arranged in a hearing aid and at least one fourth antenna arranged in the external unit. This makes wireless data exchange possible.

Advantageously the external unit can be a hearing aid programming device.

In addition the second antenna can be arranged in the vicinity of the hearing aid and the third antenna can be arranged in the vicinity of the external unit. This improves data transmission.

In a further embodiment the at least one second antenna can be arranged such that, when the hearing aid wearer turns their head, the first antenna approaches the second antenna. This offers the advantage of turning the head having less of an effect on the power received in the external unit.

The configuration can also contain two diodes oriented in different directions which are arranged in parallel to the third antenna. This enables statutory requirements for radio transmission to be adhered to.

In a further development the configuration can contain at least one first and one second capacitor, which are arranged in series to the second and third antenna. Advantageously resonant circuits can be formed by these capacitors.

The invention specifies a method for wireless transmission of data between a hearing aid and an external unit. The external unit is typically a hearing aid programming device. The method includes the steps of emitting the data by at least one first antenna arranged in the hearing aid, receiving the data output by the first antenna by at least one second antenna, emitting the data received by the second antenna by at least one third antenna connected electrically to the first antenna and receiving the data emitted by the first and third antenna by at least one fourth antenna arranged in the external unit. This offers the advantage of undisturbed data transmission between the hearing aid and the external unit.

In a development of the method the at least one second and the at least one third antenna can be arranged in a lanyard.

In a further embodiment the second antenna can be arranged in the vicinity of the hearing aid and a third antenna in the vicinity of the external unit.

Furthermore the at least one second antenna can be arranged such that, if the wearer of the hearing aid turns their head, the first antenna is approached by the second antenna.

Advantageously the antennas can be inductive antennas.

Other features which are considered as characteristic for the invention are set forth in the appended claims.

Although the invention is illustrated and described herein as embodied in a hearing aid configuration with a lanyard with an integrated antenna and an associated method for wireless transmission of data, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
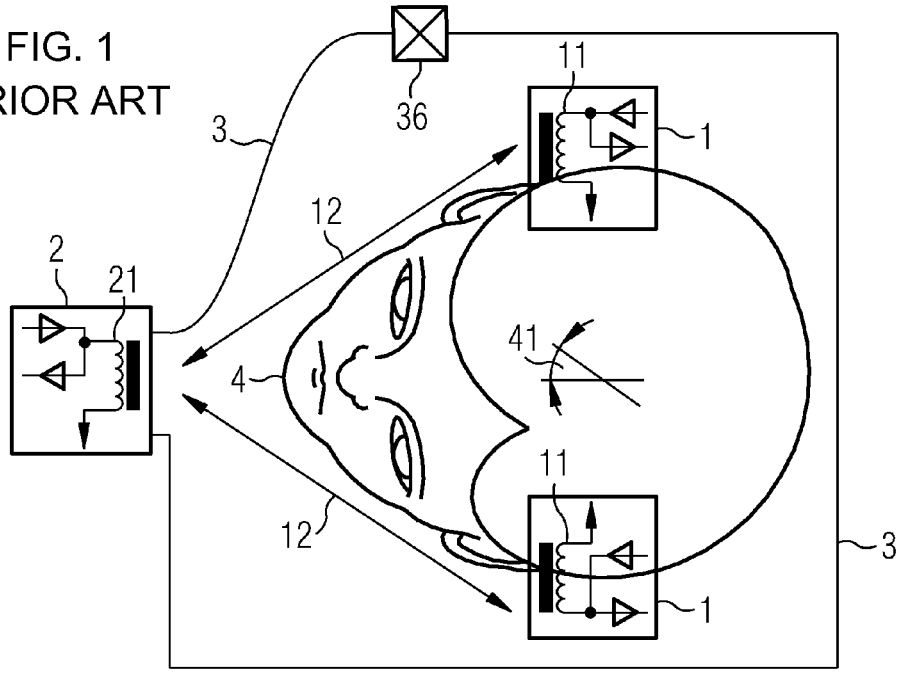
FIG. 1 PRIOR ART
FIG. 1 is an illustration of a hearing aid configuration with a lanyard according to the prior art.

Referring now to the figures of the drawing in detail and first, particularly, to FIG. 1 thereof, there is shown the principle of wireless data exchange 12 between a hearing aid 1 and a programming device 2 in accordance with the prior art. To change the settings of the hearing aid 1 data to be transmitted is exchanged with the programming device 2. Since, because of the limited signal power of the hearing aid 1, a maximum distance cannot be exceeded to the programming device 2, a hearing aid wearer—only his head 4 is shown in FIG. 1—wears the programming device 2 during the programming process on a lanyard 3 around his neck. The data transmission 12 preferably occurs inductively with the help of an inductive first antenna 11 in the hearing aid 1 and an inductive fourth antenna 21 in the programming device 2. The antennas 11, 21 are preferably embodied as wire coils wound onto a ferrite core.

To avoid strangulation during a high tensile load on the lanyard 3 a safety release element 36 is arranged in the lanyard 3, which opens the lanyard 3 when it is subjected to a predetermined force. If the hearing aid wearer turns his head to the right by an angle of rotation 41, the signal-to-noise ratio deteriorates for the hearing aid 1 worn on the right at the location of the fourth antenna 21 since the distance from the programming device 2 and the shadowing by the head 4 increases.

Figure 2:
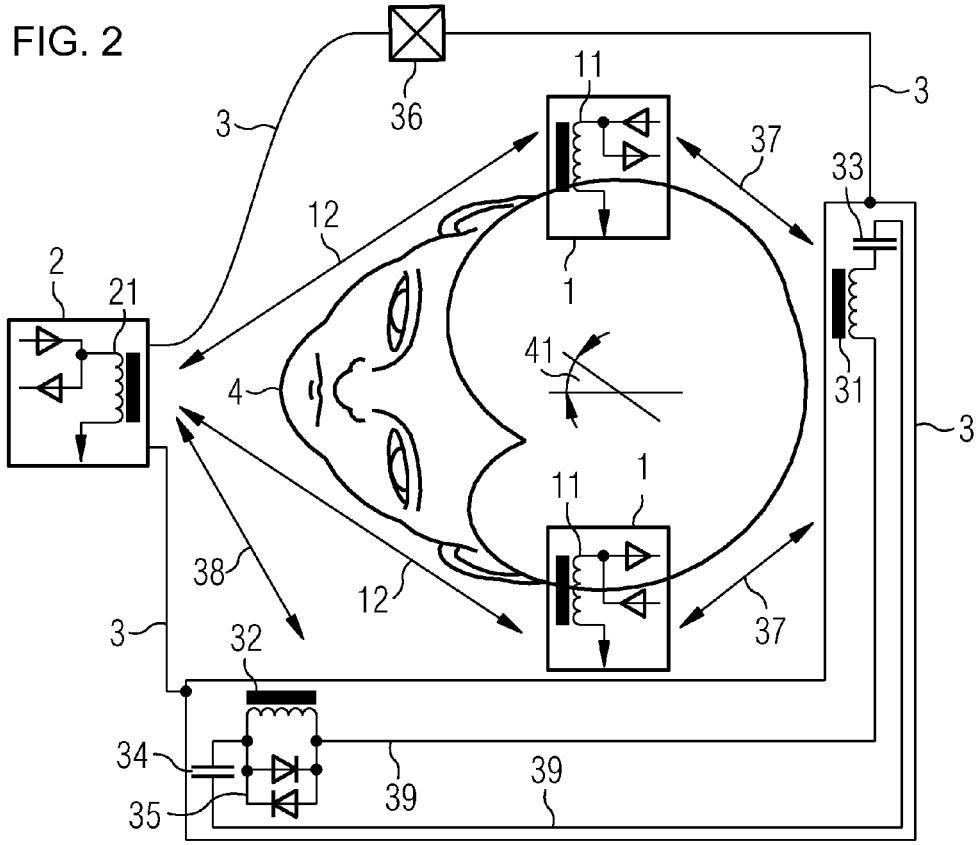
FIG. 2 is an illustration of the hearing aid configuration with two inductive antennas in the lanyard according to the invention.
Figure 3:
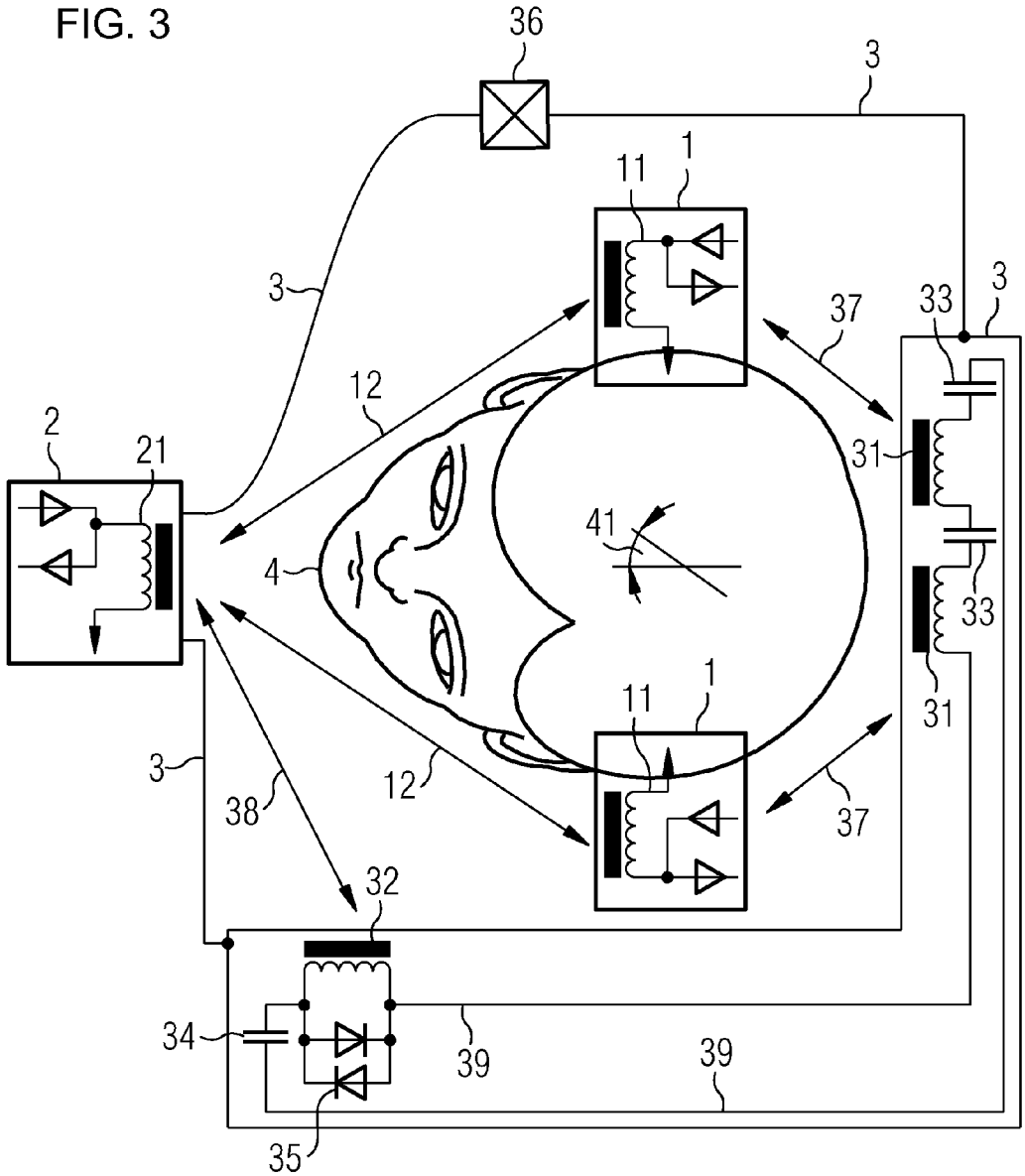
FIG. 3 is an illustration of the inventive hearing aid configuration with three inductive antennas in the lanyard.

To reduce the influence of the wearer turning his head and for generally improving the signal-to-noise ratio a configuration in accordance with FIGS. 2 and 3 is selected. FIG. 2 shows the head 4 of a hearing aid wearer with a left-hand and a right-hand hearing aid 1. For programming the hearing aid 1 the hearing aid user wears the programming device 2 attached to the lanyard 3 worn around his neck. To guard against strangulation the lanyard 3 includes a safety release element 36 which opens up when the lanyard 3 is subjected to a predetermined force.

Arranged in the two hearing aids 1 for wireless data exchange 12 with the programming device 2 is the first inductive antenna 11 in the form of a transceiver coil. The programming device 2 has a fourth inductive antenna 21 in the form of a transceiver coil as the communication partner. During data exchange 12 data is exchanged inductively between the hearing aid 1 and the programming device 2 on a direct signal path 12.

To improve the signal power an indirect signal transmission path 37, 38 is also used. A second inductive antenna 31 and a third inductive antenna 32 are incorporated into the lanyard 3 for this purpose. The antennas 31, 32 are preferably wire coils wound onto a ferrite core. The second and the third antenna 31, 32 are connected by an electrical series circuit with the aid of the electrical connecting line 39. The third inductive antenna 31 is arranged in the vicinity of the fourth inductive antenna 21 of the programming device 2 and the second inductive antenna 31 is arranged in the neck area of the hearing aid wearer in the vicinity of the hearing aid 1.

If the right-hand hearing aid 1 transmits, the second antenna 31 in the lanyard 3 receives a much stronger signal than the fourth antenna 21 built into the programming device which is further away. The field power coupled into the second antenna 31—reduced by the efficiency of the configuration—is coupled out at the third antenna 32 by the series circuit in order to then be received after a short distance by the fourth antenna 21 of the programming device 2 as an indirect signal 38. The second antenna 31 is advantageously arranged so that, for a turning of the head 41, the hearing aid 1 which is turned away from the programming device moves towards the second antenna 31. Although this makes the direct received signal 12 smaller, it simultaneously increases the indirect signal component and compensates for the loss.

To increase the efficiency of the data transmission 37, 38 the antennas 31, 32 of the lanyard 3 are operated in series resonance. To do this capacitors 33, 34 are connected locally in series to the antenna inductances 31, 32. The capacitance values are selected so that a resonance is produced for a selected working frequency.

In order to avoid losing wireless approval for the programming device 2 in the event of a subsequent replacement of the prior art lanyard by the lanyard 3 in accordance with the claimed invention, the configuration must be prevented from increasing the transmit field strength of the programming device 2. Thus two diodes 35 oriented in opposite directions to each other are connected in parallel to the third antenna 32 which limit the voltage at the third antenna 32 to the low diode voltage. The field power coupled into the third antenna 32 can thus not induce any appreciable voltage. The current in the series resonant circuit remains so small that no significant additional field strength is added in the remotely arranged second antenna 31 compared to the direct field.

FIG. 3 shows an inventive configuration similar to that depicted in FIG. 2 with the difference that two second inductive antennas 31 are now arranged in the lanyard 3. FIG. 3 shows the head of a hearing aid wearer with a left-hand and a right-hand hearing aid 1. To program the hearing aids 1, the hearing aid wearer wears around his neck the programming device 2 attached to the lanyard 3. To guard against strangulation the lanyard 3 includes a safety release element 36 which opens when the lanyard 3 is subjected to a predetermined force.

Arranged in both hearing aids 1 are first inductive antennas 11 for wireless data exchange 12 with the programming device 2. The programming device 2 has the fourth inductive antenna 21 as the communication partner. During data exchange 12 data is exchanged inductively between the hearing aids 1 and the programming device 2 on a direct path.

To improve the signal power an indirect signal transmission path 37, 38 is additionally used. Two second inductive antennas and a third inductive antenna 32 are incorporated into the lanyard 3 for this purpose. The antennas 31, 32 are preferably wire coils wound onto a ferrite core. The two second antennas and the third antenna 31, 32 are connected by an electric series circuit with the aid of an electrical connecting line 39. The third inductive antenna 31 is arranged in the vicinity of the fourth inductive antenna 21 of the programming device 2 and the two inductive antennas 31 are arranged in the neck area of the hearing aid wearer in the vicinity of the hearing aids 1.

If the hearing aid 1 is transmitting the second antenna 31 in the lanyard 3 located in the vicinity receives a much stronger signal than the fourth antenna 21 built into the programming device 2 which is further away. The field power coupled into the second antenna 31—reduced by the efficiency of the configuration—is coupled out at the third antenna 32 by the series circuit, in order to then be received after a short distance by the fourth antenna 21 of the programming device 2 as an indirect signal 38. The second antennas 31 are advantageously arranged so that, for a turning of the head 41, the hearing aid 1 which is turned away from the programming device 2 moves towards the second antenna 31. Although this makes the direct receive signal 12 smaller, the indirect signal component 37, 38 simultaneously increases and compensates for the loss.

To increase the efficiency of data transmission 37, 38 the antennas 31, 32 of the lanyard 3 are operated in series resonance. To do this capacitors 33, 34 are connected locally in series to the antenna inductances 31, 32. The capacitor values are selected so that a resonance is produced for a selected operating frequency.

In order to avoid losing wireless approval for the programming device 2 in the event of a subsequent replacement of the prior art lanyard by a lanyard 3 in accordance with the claimed invention, the configuration must be prevented from increasing the transmit field strength of the programming device 2. Thus two diodes 35 oriented in opposite directions to each other are connected in parallel to the third antenna 32, which limit the voltage at the third antenna 32 to the low diode voltage. The field power coupled into the third antenna 32 can thus not induce any appreciable voltage. The current in the series resonant circuit remains so small that no significant additional field strength is added in the remotely-arranged second antennas 31 compared to the direct field.

The advantageous placing of the hearing aids 1 close to the second antennas 31 means that a turning 41 of the head 4 during programming of the hearing aids 1 is far less critical for the hearing aid wearer than with a conventional lanyard.

Figure 4:
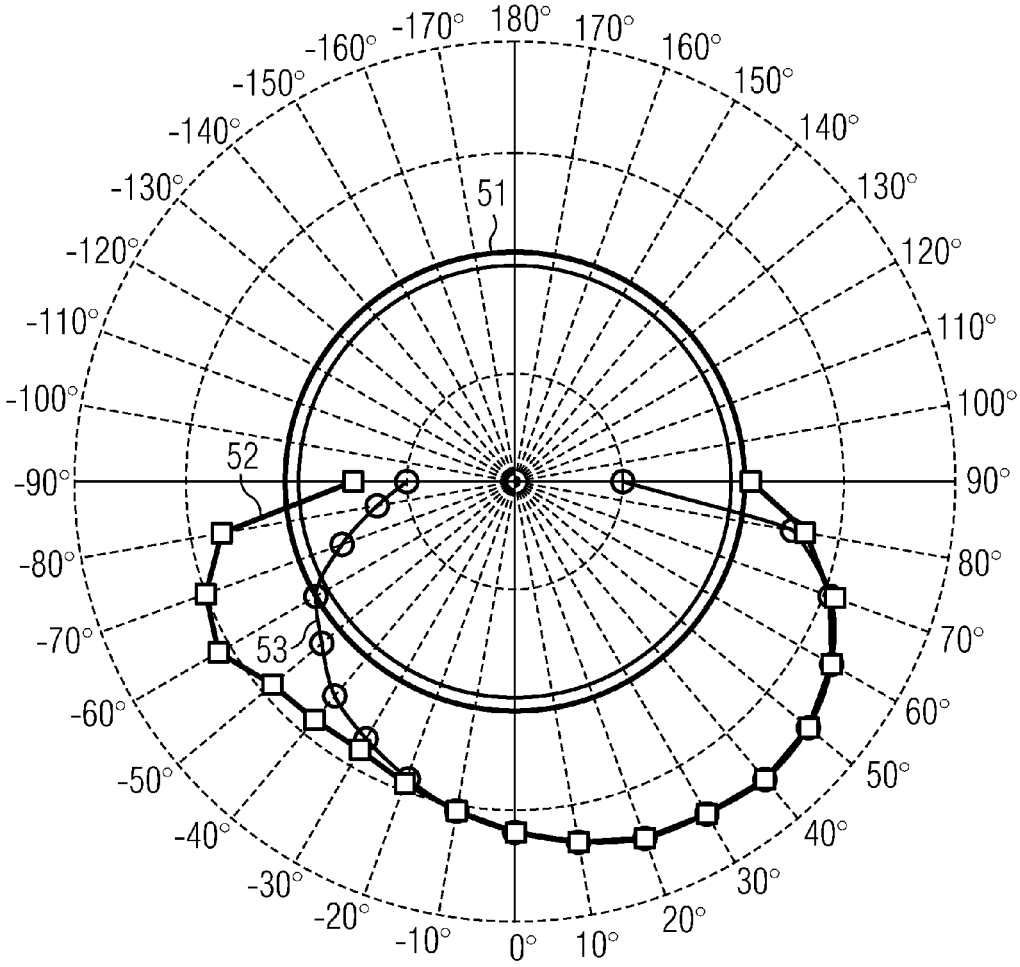
FIG. 4 is a diagram with comparison measurements.

FIG. 4 shows curves 52, 53 of a comparative measurement of the received field strength at the programming device 2 in accordance with the configuration of FIGS. 1 and 2. The right-hand hearing aid 1 is active as the transmitter. If the hearing aid wearer turns their head 4 to the right (negative angle), the signal level when using a lanyard 3 in accordance with prior art becomes critically low even at −60° (curve 53). This means that it falls below a nominal value curve 51 specifying the minimum required receive level. When the inventive lanyard 3 is used, the level (curve 52) only falls below the required value curve when the head is turned by around −85°.

Figure 5:
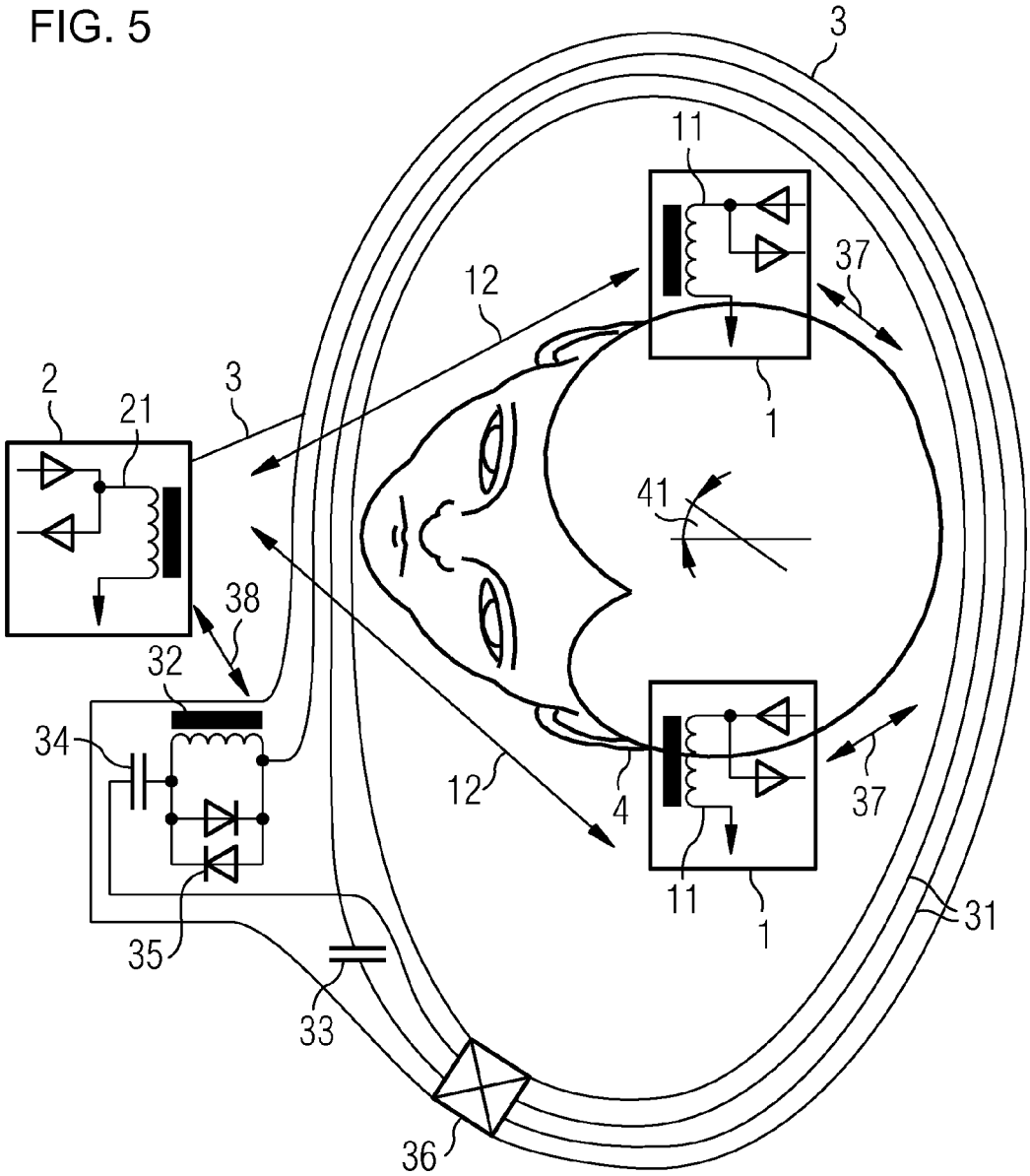
FIG. 5 is an illustration of the inventive hearing aid configuration with a loop antenna in the lanyard.

FIG. 5 shows a further inventive embodiment with the second antenna 31 being embodied as a wire loop antenna occupying a large part of the lanyard 3. The safety release element 36 contains plugs and sockets which, if safety is compromised, open up the lanyard 3 and disconnect the wire loop antenna 31. Apart from this, the explanations given for FIG. 2 apply. The longitudinal extent of the wire loop antenna 31 means that a rotational movement 41 of the head 4 does not have a disadvantageous effect on the inductive data transmission 37 between hearing aid 1 and wire loop antenna 31.

The invention claimed is:

1. A hearing aid configuration for wireless transmission of data, comprising:
- a hearing aid;
- an external unit exchanging the data with said hearing aid;
- a lanyard on which said external unit is able to be worn around a neck of a hearing aid wearer;
- an electric series circuit;
- at least one second antenna disposed in said lanyard; and
- at least one third antenna disposed in said lanyard, said at least one third antenna electrically connected in series to said second antenna.

2. The hearing aid configuration according to claim 1, wherein said second and third antennas are inductive antennas.

3. The hearing aid configuration according to claim 1, wherein the data is able to be coupled from said hearing aid into said second antenna and that the data coupled into said second antenna is able to be coupled from said third antenna into said external unit.

4. The hearing aid configuration according to claim 1, further comprising:
- at least one first antenna disposed in said hearing aid; and
- at least one fourth antenna arranged in said external unit.

5. The hearing aid configuration according to claim 1, wherein said external unit is a hearing aid programming device.

6. The hearing aid configuration according to claim 1, wherein said second antenna is disposed in a vicinity of said hearing aid and said third antenna in a vicinity of said external unit.

7. The hearing aid configuration according to claim 4, wherein said second antenna is disposed such that, when the hearing aid wearer turns his head, said first antenna approaches said second antenna.

8. The hearing aid configuration according to claim 1, further comprising two diodes oriented in opposing directions which are disposed in parallel to said third antenna.

9. The hearing aid configuration according to claim 1, further comprising at least one first capacitor and one second capacitor which are disposed in series to said second and third antennas.

10. A method for wireless transmission of data between a hearing aid and an external unit, which comprises the steps of:
- emitting of the data by at least one first antenna disposed in the hearing aid;
- accepting the data emitted by the first antenna by at least one second antenna;
- emitting the data accepted by the second antenna by at least one third antenna electrically connected in series to the second antenna; and
- accepting the data emitted by the first antenna and the third antenna by at least one fourth antenna disposed in the external unit.

11. The method according to claim 10, which further comprises providing a lanyard, in which the at least one second and at least one third antenna are disposed.

12. The method according to claim 10, which further comprises disposing the second antenna in a vicinity of the hearing aid and the third antenna in the vicinity of the external unit.

13. The method according to claim 10, which further comprises disposing the at least one second antenna such that, when the hearing aid wearer turns his head, the first antenna is approached by the second antenna.

14. The method according to claim 10, which further comprises providing inductive antennas as the first, second, third and fourth antennas.

* * * * *